US012474099B2

(12) United States Patent
Annamalai et al.

(10) Patent No.: US 12,474,099 B2
(45) Date of Patent: Nov. 18, 2025

(54) SYSTEM AND METHOD FOR DETERMINING CORRECTIVE ACTION IN ENTERPRISE WIDE DEFROST OPERATIONS

(71) Applicant: Carrier Corporation, Palm Beach Gardens, FL (US)

(72) Inventors: Vinoth Kumar Annamalai, Chennai (IN); Prabhu Raja S V, Bangalore (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 159 days.

(21) Appl. No.: 18/544,938

(22) Filed: Dec. 19, 2023

(65) Prior Publication Data

US 2024/0210082 A1 Jun. 27, 2024

Related U.S. Application Data

(60) Provisional application No. 63/476,500, filed on Dec. 21, 2022.

(51) Int. Cl.

| | |
|---|---|
| ***F25B 47/00*** | (2006.01) |
| ***F24F 11/63*** | (2018.01) |
| ***F25B 49/00*** | (2006.01) |
| ***F25B 49/02*** | (2006.01) |

(52) U.S. Cl.

CPC ..... *F25B 47/006* (2013.01); *F25B 49/005* (2013.01)

(58) Field of Classification Search

CPC .. F24F 11/41; F24F 11/62; F24F 11/63; F24F 11/64; F25B 47/00; F25B 47/006; F25B 49/005; F25B 49/02; F25B 2500/19

See application file for complete search history.

(56) References Cited

U.S. PATENT DOCUMENTS

| | | | | |
|---|---|---|---|---|
| 4,750,332 | A | 6/1988 | Jenski et al. | |
| 10,240,861 | B2 | 3/2019 | Sugar et al. | |
| 10,935,309 | B2 | 3/2021 | Devi et al. | |
| 2009/0205354 | A1* | 8/2009 | Brown | F25B 47/025 62/426 |
| 2019/0257568 | A1* | 8/2019 | Buda | F25D 21/06 |
| 2021/0333039 | A1 | 10/2021 | Kang | |

FOREIGN PATENT DOCUMENTS

WO 2020210083 A1 10/2020

OTHER PUBLICATIONS

Extended European Search Report received for EP Application No. 23217335.1, mailed on Apr. 24, 2024, 12 Pages.

* cited by examiner

*Primary Examiner* — Jonathan Bradford
(74) *Attorney, Agent, or Firm* — Drew Folgmann

(57) ABSTRACT

A system to determine one or more corrective actions for one or more refrigeration. The system includes a server configured to generate a plurality of defrosting thermal models based on an analysis of a first set of data to generate a plurality of defrosting thermal models, determine, by the plurality of defrosting thermal models, one or more thermal features based on the first set of data and generate one or more behavior profiles associated with the one or more refrigeration units. The server is further configured to define a distinguished causal mapping between the one or more thermal features and the one or more behavior profiles and determine one or more corrective actions for each of the plurality of self-executing defrost failure instances associated with one or more refrigeration units based on the distinguished causal mapping.

20 Claims, 8 Drawing Sheets

500C

| Unique Signature | Value | Profiler Output |
|---|---|---|
| RU1D1 | 2.5 | Group1 |
| RU1D2 | 2.056 | Group1 |
| RU1D3 | 0.421 | Group2 |
| RU1D4 | 0.311 | Group2 |
| RU1D5 | 0.05 | Group4 |
| RU1D6 | 0.421 | Group2 |
| RU2D1 | 0.16 | Group4 |
| RU2D2 | 0.14 | Group4 |
| RU2D3 | 0.75 | Group3 |
| RU2D4 | 0.571 | Group3 |
| RU2D5 | 0.792 | Group3 |
| RU3D1 | 2.375 | Group1 |
| RU3D2 | 1.682 | Group1 |
| RU3D3 | 1.423 | Group1 |
| RU3D4 | 1.95 | Group1 |

FIG. 5C

SYSTEM AND METHOD FOR DETERMINING CORRECTIVE ACTION IN ENTERPRISE WIDE DEFROST OPERATIONS

CROSS-REFERENCE TO RELATED APPLICATION

This patent application claims the benefit of U.S. Provisional Patent Application No. 63/476,500, filed on Dec. 21, 2022, which is incorporated by reference herein in its entirety.

BACKGROUND

This invention relates to the field of refrigeration systems, and more particularly, to a system and method for proactively determining corrective actions in enterprise wide defrost operations.

Refrigeration units (systems) play a significant role in maintaining adequate temperatures in versatile applications especially in an enterprise environment. The evaporator coil in a refrigeration unit forms frost, which accumulates over time and turns into ice at an irregular period with a non-uniform pattern. Defrost operation plays a vital role in performance of refrigeration units and failure to defrost effectively has adverse effect on product compliance. Furthermore, a poorly executed defrost operation impacts quality of the products being refrigerated.

Existing defrosting methods may be sub-optimal in one or the other aspect. For example, time-based defrosting provides complete defrosting under all scenarios irrespective of the level of frost (Scenario 1: high frost accumulation; Scenario 2: no frost formation). Furthermore, existing defrosting methods may be prone to inaccurate defrosting instructions that may not correctly match with the actual frost level leading to a failure of the defrost operation. In addition, a higher level of defrosting may negatively impact shelf life of the product being refrigerated and is also highly inefficient. Further, most of the existing adaptive defrosting methods may use the performance of only last few defrost cycles to capture the recent changes and may adjust the defrost action accordingly. Such methods may not account for historically increasing trend of ice formation and hence may lead to failure of defrost operations. In still further scenarios, sensor failures or component/part failures may lead to wrong or undesirable outcomes during a defrost operation. In addition, existing adaptive defrost methods may not capture the root cause of frosting issue which may be desirable in certain scenarios. Concomitant with such issues, in the event of a failure, existing defrosting methods are unable to provide for accurate corrective actions particularly in an enterprise-wide implementation.

Therefore, there is an ongoing need to accurately identify, distinguish failures associated with defrosting operations and determine corrective actions proactively in an enterprise-wide operation scenario.

SUMMARY

Described herein is a system to determine one or more corrective actions for one or more refrigeration units. The system comprises a server in communication with the one or more refrigeration units, the server comprising a processor coupled to a memory storing instructions executable by the processor and configured to generate a plurality of defrosting thermal models based on an analysis of a first set of data to generate a plurality of defrosting thermal models. The first set of data comprises a plurality of error signatures indicative of a plurality of self-executing defrost failure instances associated with one or more refrigeration units.

The server is configured to determine, by the plurality of defrosting thermal models, one or more thermal features based on the first set of data and generate one or more behavior profiles associated with the one or more refrigeration units. The one or more behavior profiles correspond to one or more causes for the plurality of self-executing defrost failure instances. The server is further configured to define a distinguished causal mapping between the one or more thermal features and the one or more behavior profiles and recommend one or more corrective actions for each of the plurality of self-executing defrost failure instances associated with one or more refrigeration units based on the distinguished causal mapping.

In one or more embodiments, the server is further configured to categorize the plurality of self-executing defrost failure instances into the plurality of error signatures based on an auto-detected threshold index for persistence. In one or more embodiments, the server is further configured to identify a valid self-executing defrost failure instance whenever the auto-detected threshold index for persistence is breached. In one or more embodiments, the server is further configured to determine one or more defrosting mechanisms applied to the one or more refrigeration units and label the determined one or more defrosting mechanisms to generate one or more defrosting labels, wherein the one or more labels are determined by continuous learning during the corrective action recommendation process.

In one or more embodiments, the first set of data further comprises the one or more defrosting labels. In one or more embodiments, the server is further configured to identify a first set of thermal features from the one or more thermal features and a corresponding impact of each of the first set of thermal features on a defrost outcome for each of the one or more defrosting mechanisms.

In one or more embodiments, the first set of data further comprises operation and maintenance information associated with each of the one or more refrigeration units. In one or more embodiments, the server is configured to determine the one or more defrosting mechanisms applied to the one or more refrigeration units based on defrost input data and defrost parameters corresponding to each of the one or more refrigeration units. The plurality of defrosting thermal models comprises an operation profiler, a defrost Temp by Time profiler, a defrost length profiler, a defrost set point profiler, a refrigerant Temp profiler, and supply and return Temp profiler.

In one or more embodiments, the one or more behavior profiles comprise a profile corresponding to customer operation, a profile corresponding to defrost operation, a profile corresponding to defrost performance, and a profile corresponding to one or more sensors associated with the one or more refrigeration units. In one or more embodiments, the recommended one or more corrective actions correspond to the one or more causes associated with the distinguished causal mapping between the one or more thermal features and the one or more behavior profiles.

In one or more embodiments, the server is configured to train the plurality of defrosting thermal models using one or more machine learning systems, based on the one or more thermal features corresponding to multiple behaviors of the one or more refrigeration units and corresponding maintenance information. In one or more embodiments, the server is configured to continuously measure an impact of the one or more recommended corrective actions, wherein the one or more recommended corrective actions are specific in nature based on multiple pattern distinctions mapped with maintenance information for each of the one or more refrigeration units.

Also described herein is a computer-implemented method for determining one or more corrective actions for one or more refrigeration units. The method comprises generating a plurality of defrosting thermal models based on an analysis of a first set of data to generate a plurality of defrosting thermal models. The first set of data comprises a plurality of error signatures indicative of a plurality of self-executing defrost failure instances associated with one or more refrigeration units. The method further comprises determining, by the plurality of defrosting thermal models, one or more thermal features based on the first set of data and generating one or more behavior profiles associated with the one or more refrigeration units. The one or more behavior profiles correspond to one or more causes for the plurality of self-executing defrost failure instances. The method further comprises defining a distinguished causal mapping between the one or more thermal features and the one or more behavior profiles and determining one or more corrective actions for each of the plurality of self-executing defrost failure instances associated with one or more refrigeration units based on the distinguished causal mapping.

In one or more embodiments, the method further comprises categorizing the plurality of self-executing defrost failure instances into the plurality of error signatures based on an auto-detected threshold index for persistence. In one or more embodiments, the method further comprises identifying a valid self-executing defrost failure instance whenever the auto-detected threshold index for persistence is breached. In one or more embodiments, the method further comprises determining one or more defrosting mechanisms applied to the one or more refrigeration units and label the determined one or more defrosting mechanisms to generate one or more defrosting labels.

In one or more embodiments, the first set of data further comprises the one or more defrosting labels. In one or more embodiments, the method further comprises identifying a first set of thermal features from the one or more thermal features and determining a corresponding impact of each of the first set of thermal features on a defrost outcome for each of the one or more defrosting mechanisms. The first set of data further comprises operation and maintenance information associated with each of the one or more refrigeration units.

In one or more embodiments, the method further comprises determining the one or more defrosting mechanisms applied to the one or more refrigeration units based on defrost input data and defrost parameters corresponding to each of the one or more refrigeration units. In one or more embodiments, the plurality of defrosting thermal models comprises an operation profiler, a defrost Temp by Time profiler, a defrost length profiler, a defrost set point profiler, a refrigerant Temp profiler, and supply and return Temp profiler.

In one or more embodiments, the one or more behavior profiles comprises a profile corresponding to customer operation, a profile corresponding to defrost operation, a profile corresponding to defrost performance, and a profile corresponding to one or more sensors associated with the one or more refrigeration units. In one or more embodiments, the recommend one or more corrective actions correspond to the one or more causes associated with the distinguished causal mapping between the one or more thermal features and the one or more behavior profiles.

In one or more embodiments, the method further comprises continuously learning and refining the plurality of defrosting thermal models, based on the one or more thermal features corresponding to multiple behaviors of the one or more refrigeration units and corresponding maintenance information. In one or more embodiments, the method further comprises continuously measuring an impact of the one or more recommended corrective actions. In one or more embodiments, the one or more recommended corrective actions are specific in nature based on multiple pattern distinctions mapped with maintenance information for each of the one or more refrigeration units.

Further described herein is a device configurable with one or more refrigeration units and operable to determine one or more corrective actions for one or more refrigeration units are disclosed. The device comprises a processing unit adapted to be operatively coupled to the one or more refrigeration units, the processing unit comprising a processor coupled to a memory storing instructions executable by the processor. The processing unit is configured to generate a plurality of defrosting thermal models based on an analysis of a first set of data to generate a plurality of defrosting thermal models, wherein the first set of data comprises a plurality of error signatures indicative of a plurality of self-executing defrost failure instances associated with one or more refrigeration units. The processing unit is further configured to determine, by the plurality of defrosting thermal models, one or more thermal features based on the first set of data. The processing unit is further configured to generate one or more behavior profiles associated with the one or more refrigeration units, wherein the one or more behavior profiles corresponds to one or more causes for the plurality of self-executing defrost failure instances. The processing unit is further configured to define a distinguished causal mapping between the one or more thermal features and the one or more behavior profiles and determine one or more corrective actions for each of the plurality of self-executing defrost failure instances associated with one or more refrigeration units based on the distinguished causal mapping.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

FIG. 5C illustrates exemplary outcomes of the defrost time and temperature profiler, in accordance with one or more embodiments of the invention.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

Disclosed embodiments also provide for a system and a method to accurately identify, and distinguish a failure instance of defrost operation and determine and recommend corrective (defrost) actions proactively to solve the issue related to defrosting in refrigeration units.

Figure 1:
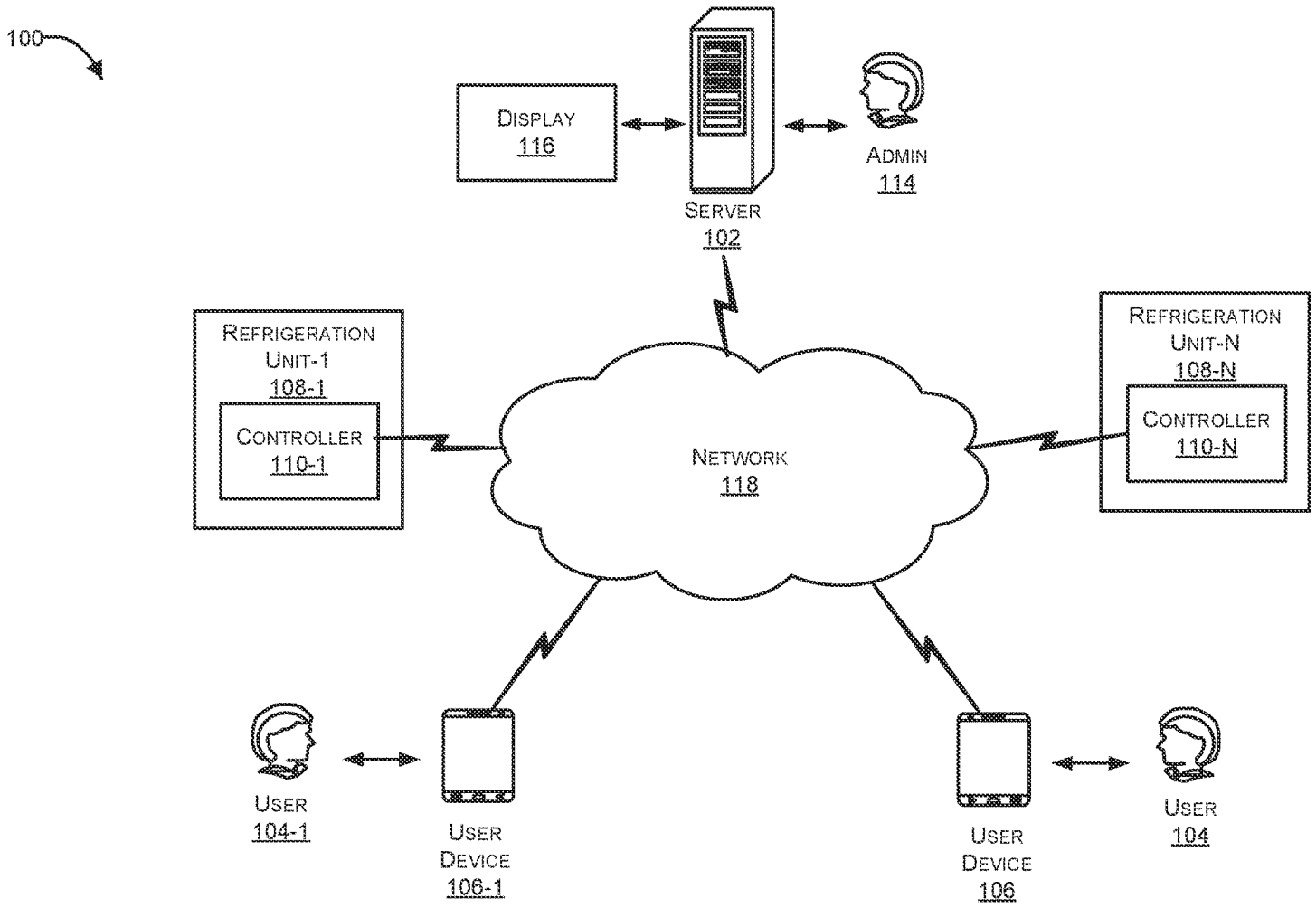
FIG. 1 is a schematic diagram illustrating an exemplary network architecture of the system for predicting ice gradient in refrigeration units in accordance with one or more embodiments of the invention.

Referring to FIG. 1, in one or more embodiments, the network architecture of the system 100 is illustrated. The system 100 determines and provides for recommendations of one or more corrective actions for one or more refrigeration units 108-1 to 108-2 (collectively referred to as refrigeration units 108, herein). While the system 100 has been explained considering that the system 100 is implemented as a web-application on a server 102, it may be understood that system 100 may also be implemented in a variety of computing systems, such as a laptop computer, a desktop computer, a notebook, a workstation, a server, a network server, a cloud-based environment and the like. It would be appreciated that the system 100 is accessed by multiple users 104-1, 104-N (collectively referred to as users 104, hereinafter), through one or more user mobile devices 106-1, 106-N (collectively referred to as user devices 106, hereinafter), or applications residing on the user devices 106. Users 104 may be an individual registered person, a group of registered persons, an organization, and the like, which are associated with the operation, service, and/or maintenance of the refrigeration units. The user 104 may also be the owner or an operator of the refrigeration units 108. Further, the system 100 may be managed by an administrator 114 (admin) at the server end 102. At the server end, the system may include a display 116 that enables the admin 114 to monitor the operation of the system 100 and the refrigeration units 108.

In one or more embodiments, the system 100 registers the users as registered users 104, upon positive verification of their registered mobile devices 106 by the admin 114 at the server end. The system 100 requests and receives, upon a first communicative coupling (or first-time registration) of the user's mobile devices 106 with the server 102, the details of the corresponding user from the mobile devices 106 of the users 104, and correspondingly registers the users as the registered user 104 upon positive verification of the corresponding user details by the admin 114. In one or more embodiments, the details of users 104 may include name, photo, age, gender, mobile number, location, biometrics details, expertise, experience, and training certificates of the registered users, but not limited to the like. Users 104 and entities 108 may access the system 100 through a mobile or client application residing on their mobile devices 106, 110 or through a web browser.

The system 100 further includes one or more controllers 110-1, 110-N (collectively referred to as controller 110, hereinafter) associated with each of the refrigeration units 108. These controllers 110 are configured to monitor real-time parameters of the refrigeration units 108 and also control the operation of the refrigeration units 108. In one or more embodiments, when there is a communication failure between the controller 110 and the server 102 due to absence of network coverage, the controller 110 stores the parameter metadata of the refrigeration units 108 and transmits to the server 102 when communication between them is re-established. The detailed operation and functional modules of the controller 110 have been described later in conjunction with FIG. 4.

The system 100 registers the refrigeration unit 108 and the corresponding controller 110 with the server 102 at the time of installation, upon communicative coupling of the refrigeration unit 108 or controller 110 with the server 102. In some embodiments, the refrigeration units 108 may be associated with the same service provider or manufacturer. In another embodiment, a set of refrigeration units 108 may be associated with one service provider or manufacturer, and another set of refrigeration units 108 may be associated with a different service provider or manufacturer. However, the server 102 allows all the refrigeration units (from different service providers/manufacturers) to be registered with and controlled centrally by the same entity (i.e., server 102) upon authorization by the user/owner 104 of the refrigeration unit 108 and validation and authorization by the admin 114. The refrigeration units 108 of different service providers/manufacturers may be configured to be operatively connected to the server 102 by reconfiguring or programming the corresponding controller 110 by an expert or technician, thereby enabling the refrigeration units 108 of different service providers to communicate with the server 102 seamlessly.

In one or more embodiments, the controller 110 is configured to monitor/capture parametric data related to the performance of the refrigeration units. The collected data are stored and transmitted to the server 102 through the network at predefined intervals or in real-time. The collected parametric data includes evaporator surface temperature, evaporator input temperature, evaporator output temperature (refrigerant flow side), supply air temperature, return air temperature, rack evaporator temperature, rack condensing temperature, defrost status, cooling status, expansion valve opening degree, and other configuration details. Along with dynamic parameters, static parametric data related to refrigeration's attributes such as size, type, design, and cooling type along with operational policies are also collected by the server 102 via the controller 110.

Further, the collected data is analysed and correlated by the server 102 to generate a plurality of self-learning models (e.g., defrosting thermal models). The collected data may be raw data captured by one or more sensors in the refrigeration units 108. In one or more embodiments, the collected data may be pre-processed data that is sanitized for removing errors and outliers based on an observed historical pattern. The data may include parameters, features, and metadata that provide characteristics of the refrigeration units' performance with regard to current and past defrost operations. These characteristics/features explain the performance of each component in the refrigeration units, which includes but is not limited to defrost characteristics, heat exchange characteristics, return air temperature characteristics, and expansion valve characteristics.

In one or more embodiments, the server 102 is configured to provide for a self-executed or self-regulated defrost operation, according to the fixed frequency and duration in the refrigeration units 108. The fixed frequency may correspond to the fixed count of defrosts over a predefined period of time and duration may correspond to the time duration for every self-regulated defrost operation. In such an embodiment, the server 102 is configured to continuously measure and learn the (defrost) outcome thereby transforming the refrigeration units into better performing and efficient assets. In the event of a self-executed defrost operation or a normal defrost operation, as described earlier, there are many instances of failure of defrost operation due to a multitude of reasons.

The detailed operation of the system 100 and server 102 has been described later in conjunction with FIGS. 2A and 2B.

The user devices 106 and the display 116 of the server 102 allow the user 104 and the admin 114 respectively to monitor the parameters data (dynamic as well as static) being notified by the controllers 110. The server 102 notifies and/or sends alert signals to the mobile devices 106 in form of text messages, emails, and the likes.

The system 100 may be operatively coupled to a website and so be operable from any Internet-enabled user device 106. Examples of user devices 106 may include but are not limited to, a portable computer, a personal digital assistant, a handheld device, and a workstation. The user devices 106 and controllers 110 are communicatively coupled or in communication with server 102 through a network 118.

In one or more embodiments, the network 118 may be a wireless network, a wired network or a combination thereof. Network 118 may be implemented as one of the different types of networks, such as intranet, local area network (LAN), wide area network (WAN), the internet, and the like. Further, the network 118 may either be a dedicated network or a shared network. The shared network represents an association of the different types of networks that use a variety of protocols, for example, Hypertext Transfer Protocol (HTTP), Transmission Control Protocol/Internet Protocol (TCP/IP), Wireless Application Protocol (WAP), and the like, to communicate with one another. Further, network 118 may include a variety of network devices, including transceivers, routers, bridges, servers, computing devices, storage devices, and the like. In one or more embodiments, the network 118 may be a cellular network or mobile communication network based on various technologies, including but not limited to, Global System for Mobile (GSM), General Packet Radio Service (GPRS), Code Division Multiple Access (CDMA), Long Term Evolution (LTE), WiMAX, 5G or 6G network protocols, and the like.

Figure 2A:
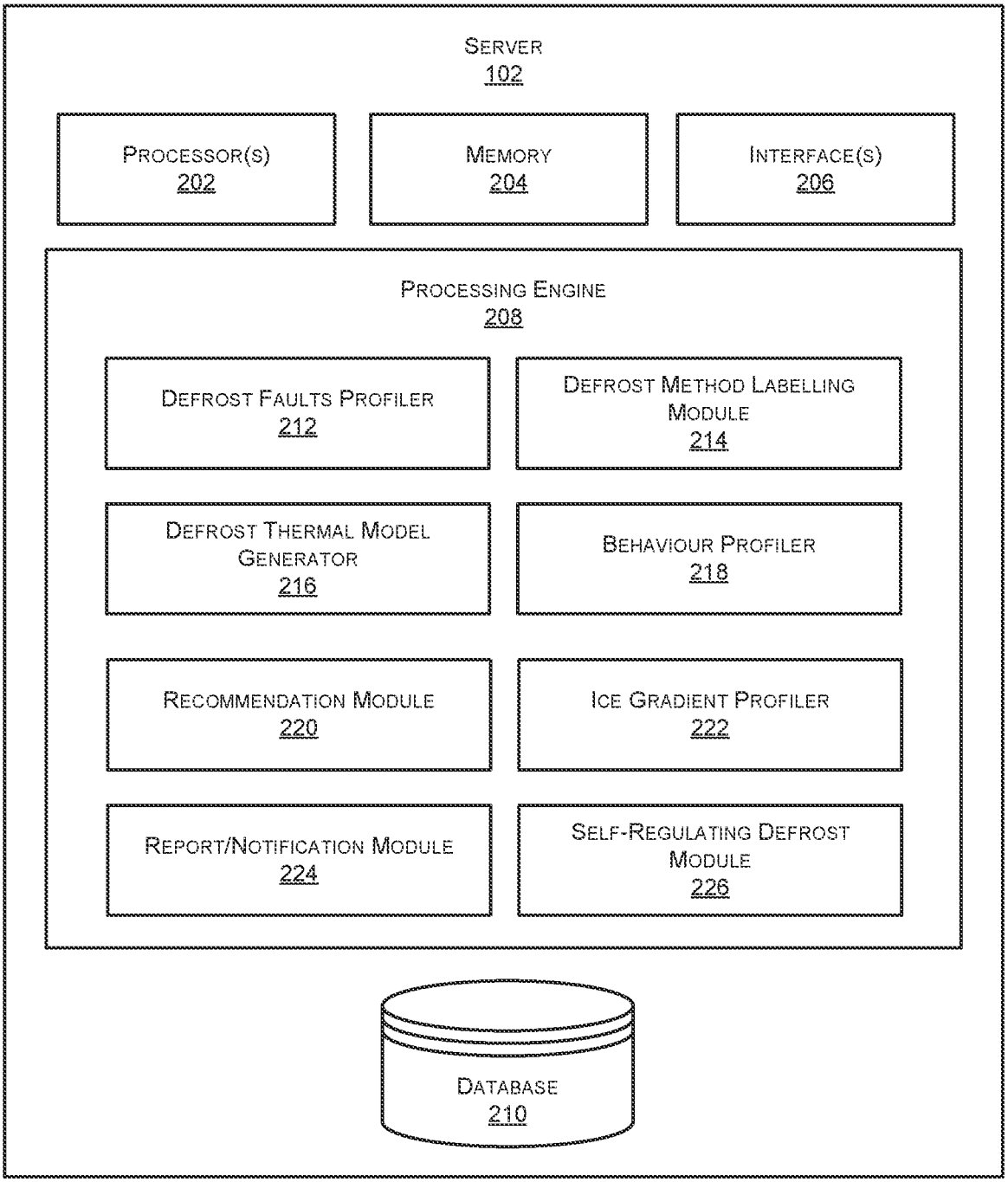
FIG. 2A is a schematic diagram illustrating exemplary functional modules of the server of the system in accordance with one or more embodiments of the invention.
Figure 2B:
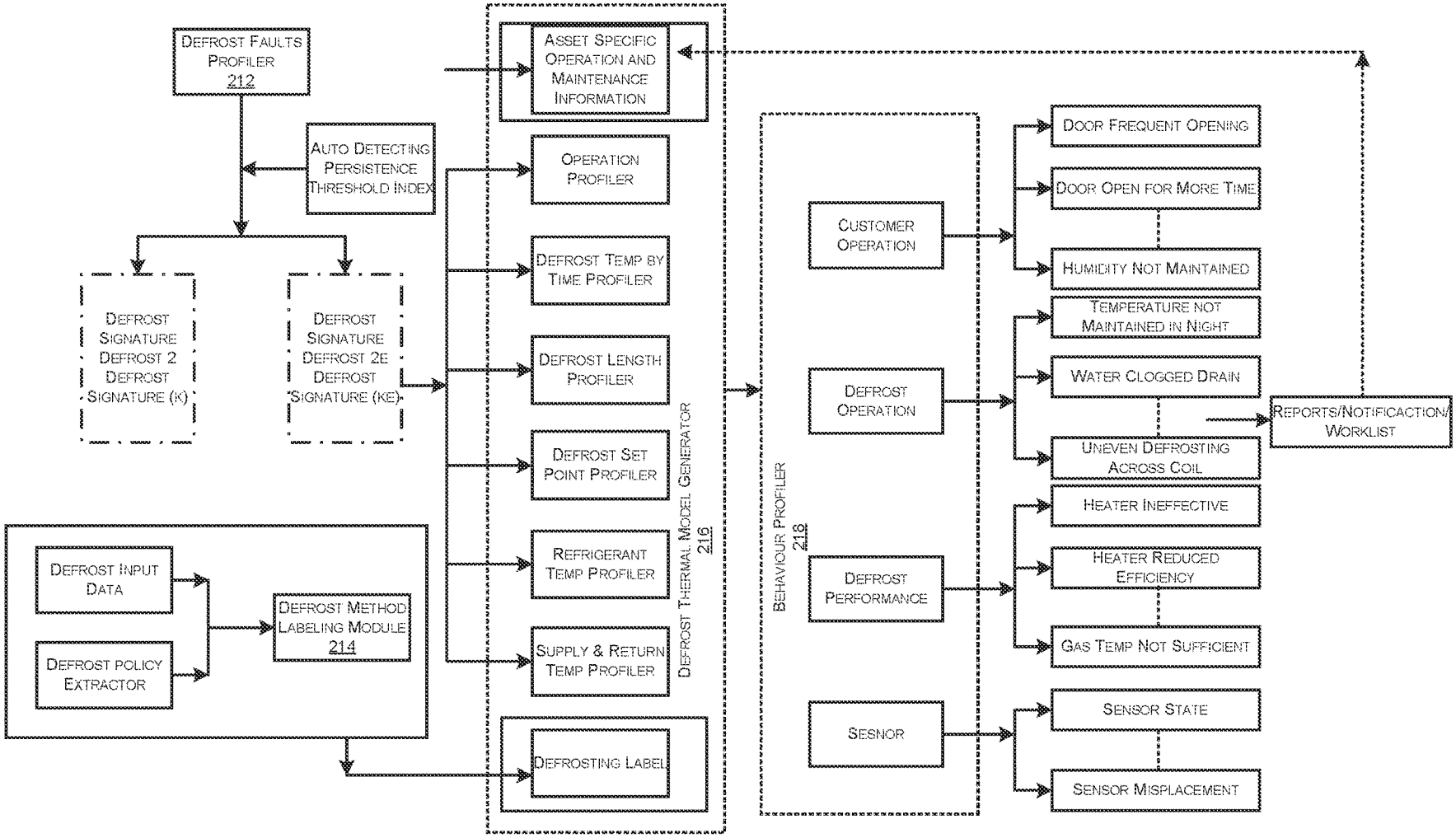
FIG. 2B is an exemplary flow diagram illustrating the working of the system in accordance with one or more embodiments of the invention.

Referring to FIGS. 2A and 2B, the functional modules of server 102 of the system 100 are illustrated. The server 102 comprises one or more processor(s) 202 operatively coupled to a memory 204. The one or more processor(s) 202 may be implemented as one or more microprocessors, microcomputers, microcontrollers, digital signal processors, central processing units, logic circuitries, and/or any devices that manipulate data based on operational instructions.

The server 102 also comprises an interface(s) 206 that may comprise a variety of interfaces, for example, interfaces for data input and output devices, referred to as I/O devices, storage devices, and the like. The interface(s) 206 includes a communication module to facilitate communication of server 102 with the controllers 110, the user devices 106, and the display 116 through the network 118. The interface(s) 206 may also provide a communication pathway for one or more internal components or units of the server 102 and with a mobile device of the admin. Examples of such internal components include, but are not limited to, processing engine(s) 208 and data (database) 210.

The processing engine(s) 208 is implemented as a combination of hardware and programming (for example, programmable instructions) to implement one or more functionalities of the processing engine(s) 208. In other examples, the processing engine(s) 208 may be implemented by an electronic circuitry. The database 210 may comprise data that is either stored or generated as a result of functionalities implemented by any of the components of the processing engine(s) 208 or the system 100.

In one or more embodiments, the processing engine(s) 208 includes a defrost faults profiler 212, a defrost method labelling module 214, a defrost thermal model generator 216, a behaviour profiler 218, a recommendation module 220, an ice gradient profiler 222, a report/notification module 224, and a self-regulating defrost module 226, and other units (s). Other unit(s) may supplement the functionalities of the processing engine 208 or the server 102.

In one or more embodiments, a defrost faults profiler 212 is configured to retrieve either from the database 210 or remotely from the controller 110, defrost operations metadata indicative of various parameters, features, and characteristics of a defrost operation. The defrost operations metadata may include operational details of the current and past self-regulating/self-executing defrost operations of the refrigeration units 108.

In one or more embodiments, the defrost faults profiler 212 may define an auto-detecting persistence threshold index as a predetermined value to be used to identify the defrost profiles (or operations) that failed due to some reason. In one or more embodiments, the defrost faults profiler 212 is configured to generate a plurality of defrost error signatures (corresponding to the defrost operations/profiles) and categorize them based on the auto-detecting persistence threshold index. For example, whenever the auto-detecting persistence threshold index is breached, the defrost faults profiler 212 categorizes the defrost error signature of the corresponding defrost operation as "valid". The categorized plurality of defrost error signatures is saved as first set of data that is indicative of a plurality of self-executing defrost failure instances associated with one or more refrigeration units.

In one or more embodiments, the defrost faults profiler 212 is further configured to categorize the plurality of self-executing defrost failure instances into the plurality of defrost error signatures based on the auto-detected threshold index for persistence. In one or more embodiments, the defrost faults profiler 212 is configured to identify a "valid" self-executing defrost failure or a defrost failure instance whenever the auto-detected threshold index for persistence is breached. The threshold index is a dynamic value that is determined by the server 102 by continuous learning from group of asset performance patterns across different sites based on operational cycles, expected asset performance, and configurational settings. The asset performance patterns are grouped according to the defrost cycle performance, for example, depending on asset operation, setpoint to be maintained, defrosting duration achieved, rate at which defrosting is conducted, and the like.

The defrost method labelling module 214 is configured to determine one or more defrosting mechanisms applied to the one or more refrigeration units and label the determined one or more defrosting mechanisms to generate one or more defrosting labels using machine learning/deep learning algorithms by continuous learning from defrost input data and defrost policy. In one or more embodiments, the first set of data further includes the one or more defrosting labels in addition to the defrost error signatures for "valid" failure instances. In one or more embodiments, the defrost labelling module 214 is configured to determine the one or more defrosting mechanisms applied to the one or more refrigeration units 108 based on the defrost input data and defrost policy corresponding to each of the one or more refrigeration units. The defrost input data may include highest defrosting temperature, time taken to change, rate of temperature change, number of defrost cycles, time of day, number of assets defrosting at a particular cycle, and the likes, which are collected at multiple frequencies such as days, weeks, months. Further, the defrost parameters may include defrosting duration, defrost set points, and the like. In one or more embodiments, an admin user may define the defrost parameters based on the specifications of the one or more refrigeration units. Alternatively, the server 102 may automatically define the defrost parameters based on the specifications of the one or more refrigeration units.

In one or more embodiments, the defrost thermal model generator 216 is configured to identify a first set of thermal features from one or more thermal features and a corresponding impact of each of the first set of thermal features on a defrost outcome for each of the one or more defrosting mechanisms identified and labelled by the defrost method labelling module 214.

In one or more embodiments, the defrost thermal model generator 216 is configured to generate a plurality of defrosting thermal models based on an analysis of the first set of data to generate a plurality of defrosting thermal models. In one or more embodiments, the plurality of defrosting thermal models includes an operation profiler, a defrost Temp by Time profiler, a defrost length profiler, a defrost set point profiler, a refrigerant Temp profiler, and supply and return Temp profiler as shown in FIG. 2B. Each of these models or profilers profiles a plurality of defrost cycles into one or more profiles or groups. The defrost Temp by Time profiler may profile common patterns of defrost temperature across the various instances of time during the plurality of defrost cycles. The defrost length profiler may profile common patterns of duration or length of the corresponding defrost cycles for the refrigeration units. The defrost set point profiler may profile common patterns of the defrost set point values during the plurality of defrost cycles, above which the defrost cycles may be initiated in the refrigeration units. The refrigerant temperature profiler may profile common patterns of the refrigerant temperature in the refrigeration units during the plurality of defrost cycles. The supply and return temp profiler may profile common patterns of the temperature of supply air and return air in the refrigeration units during the plurality of defrost cycles.

Figure 5A:
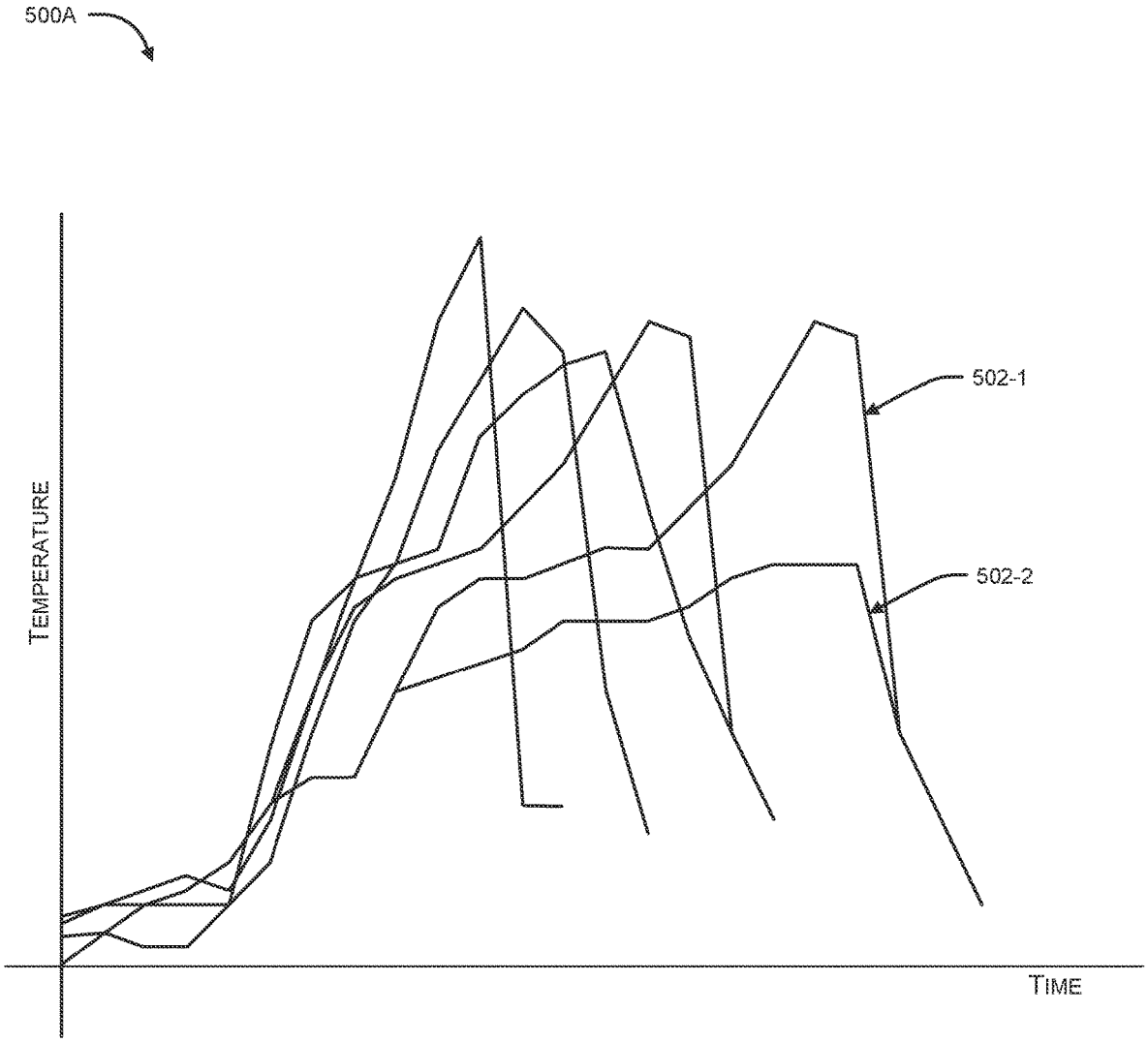
FIG. 5A is a graph depicting exemplary defrost faults profiler signatures associated with multiple defrost cycles of one or more refrigeration units of the system, in accordance with one or more embodiments of the invention.

As described earlier, the first set of data includes a plurality of error signatures associated with multiple defrost cycles (generated and categorized by defrost fault profiler 212) as shown in FIG. 5A, which are indicative of a plurality of self-executing defrost failure instances associated with one or more refrigeration units 108. The first set of data may further include one or more of defrosting labels generated by defrost method labelling module 214, and asset specific operation and maintenance information associated with the refrigeration units 108.

Figure 5B:
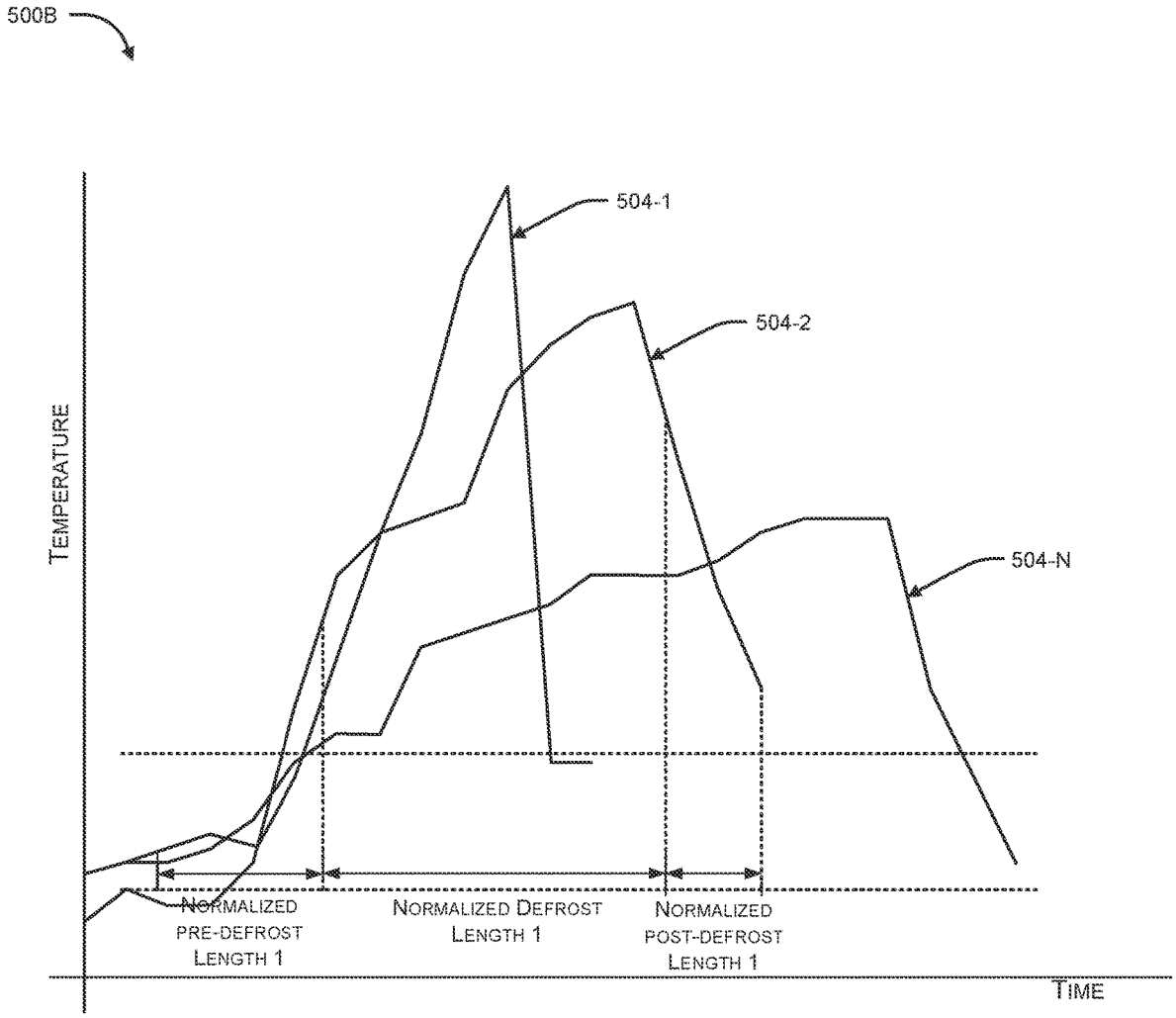
FIG. 5B illustrates exemplary outcomes of the defrost length profiler, in accordance with one or more embodiments of the invention.

In one or more embodiments, the defrost thermal model generator 216 is further configured to determine, by using the plurality of defrosting thermal models, one or more thermal features based on the first set of data. In one or more embodiments, the one or more thermal features may include defrost temperature by time profile, defrost length, defrost set point, refrigerant temperature, supply and return temperature. In another embodiment, the one or more thermal features may correspond to any characteristic feature that is uniquely identifiable, distinguishable, and measurable amongst other features. Referring to FIGS. 5A to 5C, the defrost fault profiler may generate and categorize the self-executing defrost failure instances during the multiple defrost cycles 500A as the error signatures 502-1, 502-2 as shown in FIG. 5A. Further, the outcomes generated by each of the profilers for multiple refrigeration units may be used to determine common patterns across the various defrost fault profiles. In one or more embodiments, the outcome 500B generated by the defrost length profiler is shown in FIG. 5B. As illustrated, the defrost length profiler may profile common patterns of duration/length of the corresponding defrost cycles 500A into different groups 504-1, 504-2, and 504-N based on normalized pre-defrost length, normalized defrost length, and normalized post-defrost length of the defrost cycles 500A. In one or more embodiments, the outcome 500C generated by the defrost temp by time profile based on defrost temperature for different defrost cycles of multiple refrigeration units is shown in a tabular form in FIG. 5C. As illustrated, the defrost cycles for a first refrigeration unit among the multiple refrigeration units may be provided with a unique signature RU1D1 to R1D6 for six defrost cycles. The defrost cycles for a second refrigeration unit among the multiple refrigeration units may be provided with a unique signature RU2D1 to RU1D5 for five defrost cycles. The defrost cycles for a third refrigeration unit among the multiple refrigeration units may be provided with a unique signature RU3D1 to RU3D4 for four defrost cycles. The defrost temp by time profiler may group the common patterns of the signatures into different groups including Group-1 to Group-4, based on the values of the signatures. For instance, the signatures RU1D1, RU1D2, and RU3D1 to RU3D4 having values ranging from 1.682 to 2.5 may be grouped together in Group-1. The signatures RU1D3, RU1D4, and RU1D6 having values ranging from 0.311 to 0.421 may be grouped together in Group-2. The signatures RU2D3 to RU3D5 having values ranging from 0.571 to 0.792 may be grouped together in Group-3. The signatures RU1D5, RU2D1 to RU2D2 having values ranging from 0.05 to 0.16 may be grouped together in Group-4. Accordingly, the common patterns may be further grouped together in each of the profilers with the help of work order information, domain expert and feedback from the outcome generated. These groups may be associated together to form uniquely identifiable, distinguishable and measurable behaviours.

The behaviour profiler 218 is configured to generate one or more behavior profiles associated with the one or more refrigeration units 108. In one or more embodiments, the one or more behaviour profiles correspond to one or more probable causes for the plurality of self-executing defrost failure instances. The behaviour profiler 218 is further configured to define a distinguished causal mapping between the one or more thermal features and the one or more behaviour profiles. In one or more embodiment, this distinguished causal mapping may be one-to-one mapping or one-to-many mapping or many-to-one mapping. The causal mapping is distinguished in the manner that each of the one or more thermal features are distinctly mapped to at least one behavior profile. In an aspect of the disclosure, the mapping approximates a cause-effect relationship between the one or more thermal features and the one or more behaviour profiles. The distinguished mapping enables accurate identification of most probable cause of failure instance of the defrost operation. In one or more embodiments, the one or more behaviour profiles include a profile corresponding to customer operation, a profile corresponding to defrost operation, a profile corresponding to defrost performance, and a profile corresponding to one or more sensors associated with the one or more refrigeration units. In addition, the additional behavior profiles may also be added along with the causal mapping by continuous learning.

In one or more embodiments, each of the behaviour profiles correspond to one or more probable causes for the failure instance of defrost operation of the refrigeration units 108. For example, the behaviour profile for customer operation corresponds to causes that may include frequent door opening, opening of door for a time period that exceeds a predetermined threshold, non-maintenance of humidity levels in the refrigeration units 108, or other customer operation related causes. In another example, the behaviour profile for defrost operation corresponds to causes that may include non-maintenance of temperature during night, water clogged drain, and uneven defrosting across coils, or other defrost operation related causes. In yet another example, the behaviour profile for defrost performance corresponds to causes that include ineffective heater, reduced heater efficiency, and insufficient gas temperature, or other defrost performance related causes. In yet another example, the behaviour profile for sensor corresponds to causes that include sensor failure and sensor misplacement, or other sensor related causes.

The recommendation module 220 is configured to recommend one or more corrective actions for each of the plurality of self-executing defrost failure instances associated with one or more refrigeration units based on the distinguished causal mapping. In one or more embodiments, the recommended one or more corrective actions correspond to the one or more causes (as described in above examples) associated with the distinguished causal mapping between the one or more thermal features and the one or more behaviour profiles.

In one or more embodiments, the server 102 (or one or more modules/processing engines) is configured to continuously learn and refine the defrosting thermal models, based on the one or more thermal features corresponding to multiple behaviors of the one or more refrigeration units and corresponding maintenance information. The server 102 is continuously trained with refrigeration unit (asset) specific information, maintenance information of the assets and field feedback from technicians. In one or more embodiments, the server 102 is configured to continuously measure an impact of the one or more recommended corrective actions, wherein the one or more recommended corrective actions are specific in nature based on multiple pattern distinctions mapped with maintenance information for each of the one or more refrigeration units. The behavior profiler receives additional or new causes which may be added to improvise and update the server 102 when auto generation of corrective action is not possible.

The ice gradient profiler 222 is configured to predict an ice profile and create priority rank by outcome impact to create ice gradient index. In one or more embodiments, the ice gradient profiler 222 uses product group profiles to generate product groups, product quality impact index to derive thresholds of product, and product compliance to get intensity of non-compliance by time and temperature. In one or more embodiments, all the three inputs are correlated to generate product constraints. In one or more embodiments, the ice gradient profiler 222 is configured to exert design constraints and operational constraints to enable the self-regulating defrost module 226 to self-regulate defrost events in terms of time, temperature and frequency.

The self-regulating defrost module 226 is configured to provide for a self-executed or self-regulated defrost operation, deposing the fixed frequency and duration in the refrigeration units 108. In one or more embodiments, the self-regulating defrost module 226 is configured to continuously measure and learn the (defrost) outcomes that are fed as input to the defrost faults profiler module 212 for instance to accurately identify failure instances.

The report/notification module 224 is configured to generate one or more reports, notifications or worklist that contains recommendations (of one or more corrective actions) with regard to failure instances of defrost operations. In one or more embodiments, a technician or a user may refer to the one or more reports, notifications or worklist to rectify the issue and/or solve the problem related to the defrost failure instance for a particular refrigeration unit 108. The system 100 may provide proactive corrective actions along with necessary parts to be taken by the technician or team visiting the particular refrigeration unit to be rectified, to solve the problem. The server 102 notifies the proactive corrective actions and necessary parts information to the mobile devices 106, 110 of technician in form of text messages, emails, and the likes.

The database 210 may store metadata, parameters data, pre-processed data, the plurality of defrost error signatures, the plurality of defrosting thermal models, the one or more thermal features, the one or more behaviour profiles, the one or more cases and the one or more recommended corrective actions, worklists, reports, and notifications amongst other data.

The other data that the server 102 may collect and utilize may include time series parametric data from the refrigeration system 108 (or controller 110). The collected data includes evaporator surface temperature, evaporator input temperature, evaporator output temperature (refrigerant flow side), supply air temperature, return air temperature, rack evaporator temperature, rack condensing temperature, defrost status, cooling status, expansion valve opening degree (OD %), and other configuration details. Along with the dynamic parametric data, static parametric data is received by the server 102, which includes the type of controller, type of asset, cooling type as attributes, and operational policies associated with the refrigeration unit 108.

As refrigeration unit's behaviours may vary at multiple levels, for instance, RAT performance may vary when cooling is on and off, when the door is open and when the door is not open, when the cabinet is overstocked, when humidity is high, when expansion valve operates due to lack of refrigerant, and when expansion valve operates due to superheating. Therefore, capturing the features at multiple levels helps determine the frosting and defrosting characteristics by normalizing other behaviours. Normalizing the behaviours like overstocking, air circulation, low refrigerant, sensor failures, and the like is employed in the system to determine the probable cause of failure or problem in the defrost operation.

In one or more embodiments, the other modules may enable the server 102 to derive data based on the information available from known refrigeration units. Data is derived from the parameters already available with the system 100. These derived parameters such as superheat may be derived from evaporator input and evaporator output temperature, cooling mode may be derived from expansion valve, defrost status may be derived from evaporator temperature, and the like. Such other modules are useful for legacy refrigeration units that are not associated with the service provider or refrigeration units where the measured parameters are less or are from a different service provider (vendor or manufacturer). Such other modules enable the server 102 to determine unavailable parameters associated with a set of refrigeration units among the refrigeration units based on the available (known) parameters associated with another set of refrigeration units among the refrigeration units.

In a one or more embodiments, one or more Machine Learning (ML) modules may enable the server 102 to update the database 210 with a set of data packets comprising one or more of the captured parameters, the generated characteristic modules/features, systematic/non-systematic events and corresponding threshold values, the identified defrosting pattern, determined quantum of icing and rate of ice formation, and predicted ice gradients.

In one or more embodiments, one or more machine learning systems may be used to train one or more models described herein. The machine learning systems may use one or more of supervised learning, semi-supervised, unsupervised learning, reinforcement learning, and/or other machine learning techniques). In one or more embodiments, the machine learning models may include decision trees, support vector machines, regression analysis, Bayesian networks, random forest learning, dimensionality reduction algorithms, boosting algorithms, artificial neural networks (e.g., fully connected neural networks, deep convolutional neural networks, or recurrent neural networks), deep learning, and/or other machine learning models. For example, in one or more embodiments, the machine learning systems may use unsupervised learning algorithms to train the one or more models (e.g., the thermal models). For example, in one or more embodiments, unsupervised learning algorithms may be configured to use input data that is not labelled, classified, or categorized. The unsupervised learning algorithms may be configured to identify similarities in the input data and to group new data based on presence or absence of the identified similarities. Using unsupervised learning algorithms may be beneficial because it may allow for discovering hidden trends and patterns or extracting data features from the input data that would have been difficult to obtain if other techniques were used.

It is to be understood that the machine learning systems are described here as examples for techniques for identifying causes of defrost failures and determining corrective actions. However, other techniques, are also contemplated by the present disclosure. As such, any computer implemented techniques, or other machine learning techniques for identifying causes of defrost failures and determining corrective actions are contemplated by the present disclosure.

Figure 3:
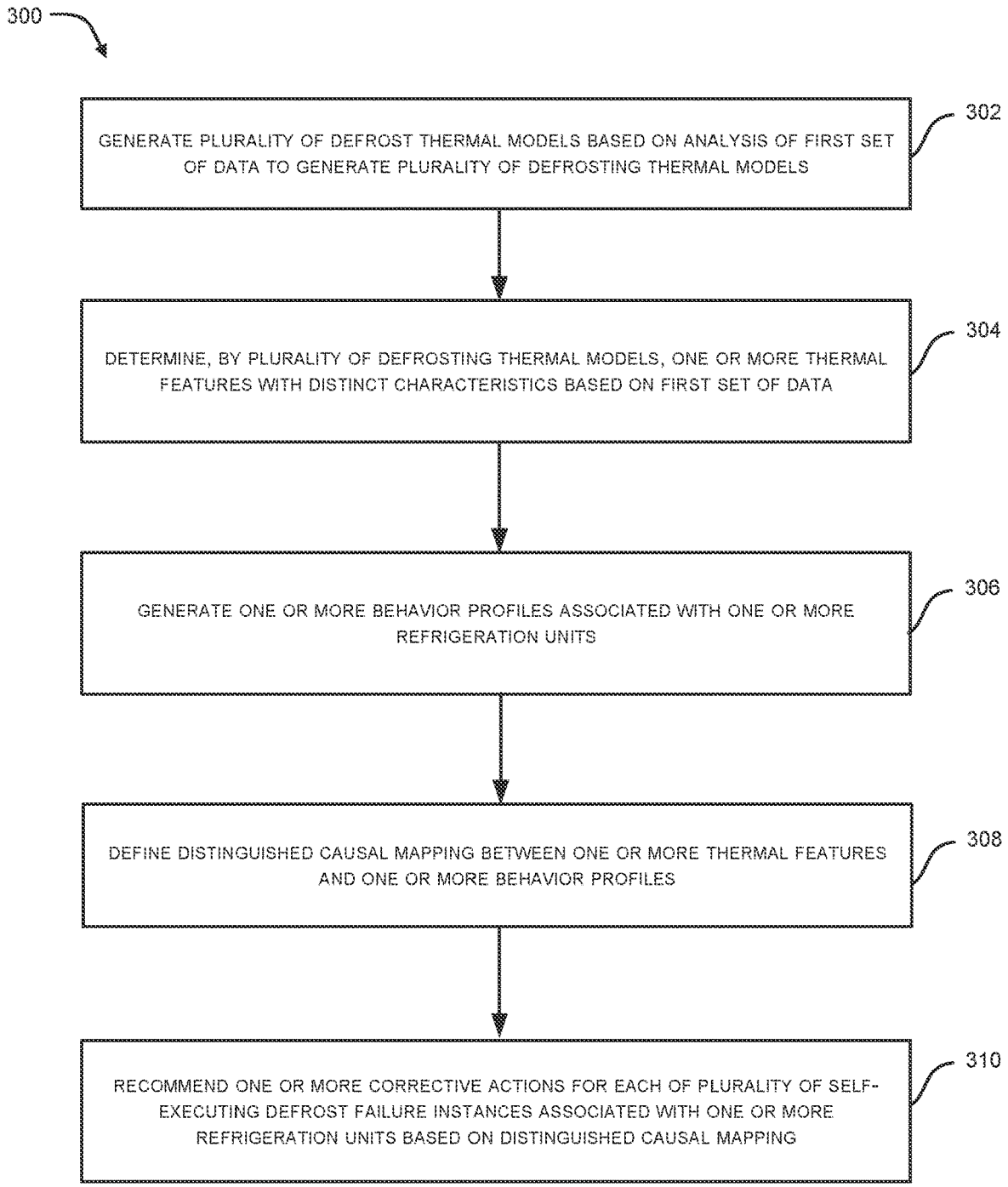
FIG. 3 is a flow diagram illustrating an exemplary embodiment of a method for determining one or more corrective actions for one or more refrigeration units in accordance with one or more embodiments of the invention.

Referring to FIG. 3, exemplary steps involved in a method for recommending one or more corrective actions for one or more refrigeration units are illustrated. Method 300 includes step 302 of generating a plurality of defrosting thermal models based on an analysis of a first set of data to generate a plurality of defrosting thermal models. In one or more embodiments, the first set of data comprises a plurality of error signatures indicative of a plurality of self-executing defrost failure instances associated with one or more refrigeration units.

The method 300 further includes the step 304 of determining, by the plurality of defrosting thermal models, one or more thermal features based on the first set of data.

The method 300 further includes the step 306 of generating one or more behavior profiles associated with the one or more refrigeration units. In one or more embodiments, the one or more behavior profiles correspond to one or more causes for the plurality of self-executing defrost failure instances.

The method 300 further includes the step 308 of defining a distinguished causal mapping between the one or more thermal features and the one or more behavior profiles. The causes for the defrost failure are included based on continuous learning from the feedback received from technician. However, if any cause is not able to be determined, such cause may be treated separately to get feedback from the technician and further include them in the causes.

The method 300 further includes the step 310 of recommending one or more corrective actions for each of the plurality of self-executing defrost failure instances associated with one or more refrigeration units based on the distinguished causal mapping.

The method 300 further includes the step of categorizing the plurality of self-executing defrost failure instances into the plurality of error signatures based on an auto-detected threshold index for persistence.

In one or more embodiments, the method 300 further includes the step of identifying a valid self-executing defrost failure instance whenever the auto-detected threshold index for persistence is breached. In one or more embodiments, the method 300 further includes the step of determining one or more defrosting mechanisms applied to the one or more refrigeration units and label the determined one or more defrosting mechanisms to generate one or more defrosting labels.

In one or more embodiments, the first set of data further comprises the one or more defrosting labels. In one or more embodiments, the method 300 further includes the step of identifying a first set of thermal features from the one or more thermal features and the step of determining a corresponding impact of each of the first set of thermal features on a defrost outcome for each of the one or more defrosting mechanisms. In one or more embodiments, the first set of data further comprises operation and maintenance information associated with each of the one or more refrigeration units.

In one or more embodiments, the method 300 further includes the step of determining the one or more defrosting mechanisms applied to the one or more refrigeration units based on defrost input data and defrost policy corresponding to each of the one or more refrigeration units.

In one or more embodiments, the method 300 further includes the step of continuously learning and refining the plurality of defrosting thermal models, based on the one or more thermal features corresponding to multiple behaviors of the one or more refrigeration units and corresponding maintenance information. In one or more embodiments, the method further includes the step of continuously measuring an impact of the one or more recommended corrective actions. In one or more embodiments, the one or more recommended corrective actions are specific in nature based on multiple pattern distinctions mapped with maintenance information for each of the one or more refrigeration units.

Figure 4:
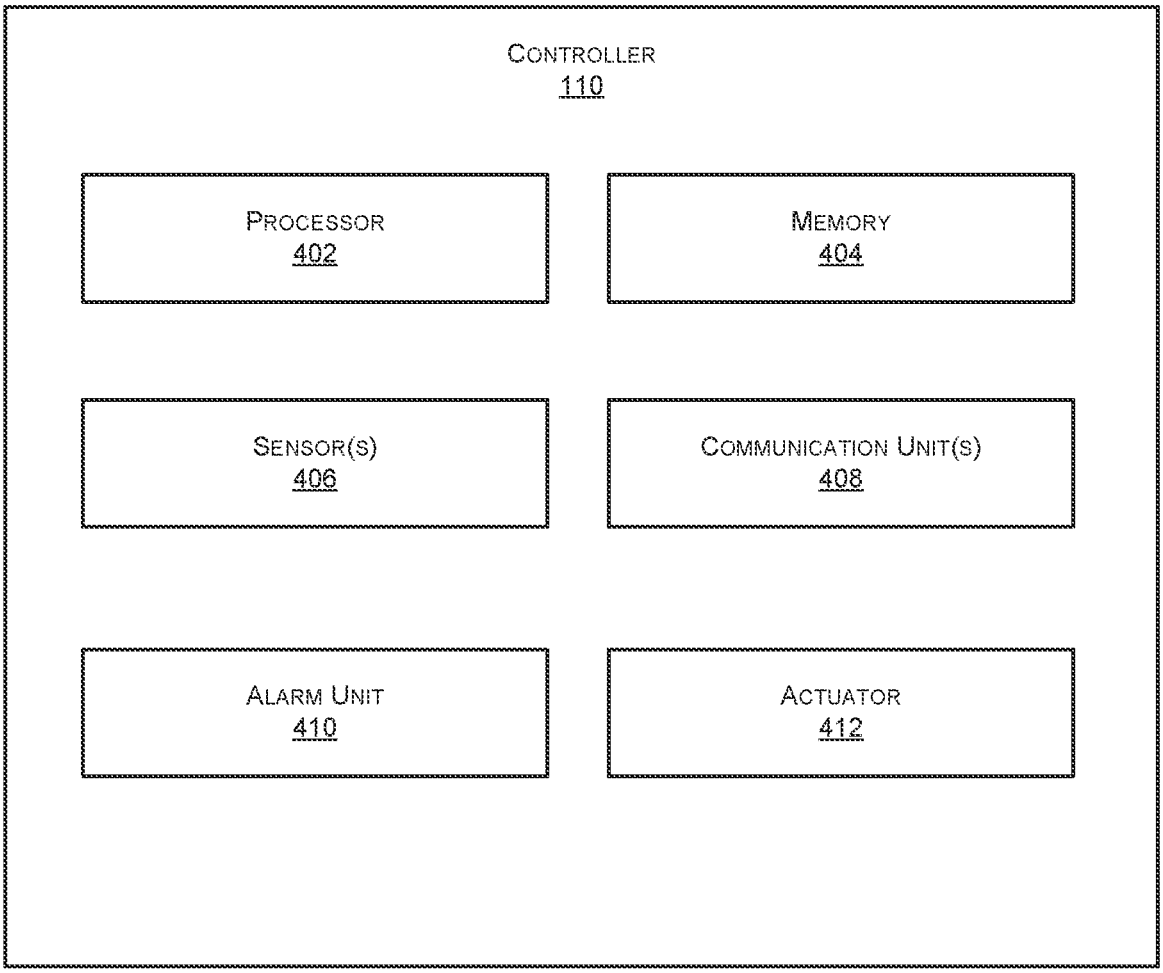
FIG. 4 is a schematic diagram illustrating the block diagram of the controller associated with the refrigeration units in accordance with one or more embodiments of the invention.

Referring to FIG. 4, an exemplary block diagram of the controller 110 installed in refrigeration units 108 of the system 100 is illustrated. The controller 110 includes a processor 402, a memory 404, a set of sensors 406, a communication unit 408 (such as a transceiver), an alarm unit 410, and an actuator 412 being configured within a single housing that may be installed in the refrigeration units 108 or disposed of within the refrigeration units 108. The processor 402 is coupled to the memory 404, the sensors 406, the transceiver or communication unit 408, the alarm unit 410, and the actuator 412. The processor 402 includes suitable logic, circuitry, and/or interfaces that are operable to execute one or more instructions stored in the memory 404 to perform a predetermined operation. The memory 404 may be operable to store the one or more instructions. The processor 402 may be implemented using the processor 402 known in the art. Some of the commonly known memory 404 implementations include, but are not limited to, a random access memory (RAM), a read only memory (ROM), a hard disk drive (HDD), and a secure digital (SD) card. Further, memory 404 includes the one or more instructions that are executable by the processor 402 to perform specific operations. It is apparent to a person having ordinary skills in the art that the one or more instructions stored in the memory 404 enables the hardware of the mobile device to perform the predetermined operation.

The sensors 406 are configured to monitor the dynamic parameters of the refrigeration units 108. These dynamic parameters may include evaporator surface temperature, evaporator input temperature, evaporator output temperature, supply air temperature, return air temperature, rack evaporator temperature, rack condensing temperature, defrost status, cooling status, and expansion valve opening degree. Further, the parameters may also include static parameters such as the type of controller used in the corresponding refrigeration unit, attributes comprising type, size, design, and cooling type of the one or more refrigeration units, and operational policies associated with the one or more refrigeration unit, which may be manually collected. The sensors 406 may include temperature sensors, light sensors, humidity sensors, gas sensors, pressure sensors, and flow meters, but are not limited to the like. The captured parametric data of the refrigeration units 108 are then transmitted to the server 102 via transceiver 408 for further processing as already explained in detail in FIGS. 2A and 2B.

In some embodiments, the sensors 406 may be distributed at various positions within the zones of refrigeration units 108, and these distributed sensors 406 may be operatively connected to the processor 402 of the controller 110 via wired media or wireless media. In other embodiments, all the sensors 406 of the controller 110 may be positioned over a single frame that may be installed at different zones of the refrigeration units 108.

The communication unit 408 (transceiver 508) transmits and receives messages and data to/from the server 102 and the devices 106. Examples of the transceiver 408 may include but are not limited to, an antenna, an Ethernet port, an USB port, or any other port that may be configured to receive and transmit location and parameters data. The controller 110 further includes a power source such as a battery that is within the housing of the controller 110 to supply electrical power to the components of the controller 110. Besides, the controller 110 may also be electrically connected to a battery or power source of the refrigeration unit 108.

In one example, a GPS may be provided in the controller 110 to capture the location (coordinates) of the refrigeration unit 108, and the GPS data may be directly transmitted to server 102 via the transceiver 408, which may allow the user 104 to identify and reach at the installation site of the refrigeration unit 108 when required. In another example, the location of refrigeration unit 108 may be captured based on the interaction of a WIFI module of the controller 110 with nearby available WIFI access points. Once the controller 110 is in a range of any nearby available WIFI access points, the controller 110 determines its location to be the same as the location of the nearby available WIFI access points. In yet another example, the location of refrigeration unit 108 may be captured based on the interaction of the transceiver 408 of the controller 110 with a nearby cellular tower. Once the controller 110 is in the range of nearby cellular towers, controller 110 determines its location based on corresponding cellular tower triangulation.

In one or more embodiments, the alarm unit 410 enables the controller 110 to generate and transmit a set of alert signals to the mobile devices 106 of the users 104 based on the priority of the predicted ice gradient. Further, when the threshold value of the predicted ice gradient exceeds a predefined unsafe value, the server 102 may directly transmit a set of alert signals to the defrosting unit of the corresponding refrigeration unit via the controller 110 to enable self-executing/self-regulating defrosting of the corresponding refrigeration unit 108. In one or more embodiments, the controller 110 may also include actuators 412 that are configured to activate the defrosting system of the refrigeration unit 108 based on the priority of ice gradient mitigation.

Thus, the invention provides a method and a system for determining one or more corrective actions for refrigeration units to rectify one or more failure instances of defrost operations.

According to one or more embodiments, a device (not shown) is disclosed, which is adapted to be connected or configured with multiple refrigeration units at an area of interest (AOI) and is capable of determining corrective actions for the refrigeration units in the event of a failed defrost operation. The device may replace the server 102 and perform all the combined functionalities of the server 102 as well as the controller 110 in the AOI. The device may be installed at the AOI near the refrigeration units 108 such that the corresponding refrigeration units 108 remain in a network coverage area around the device. In some embodiments, the device remains in communication with the controller 110 of all the refrigeration units 108 at the AOI. In one or more embodiments, the device may include the controller 110 or associated components disposed of within a housing of the device, which allows the device to be operatively connected to the refrigeration unit and operate as the controller 110 for all the refrigeration units 108. Additionally, the device acts as the server 102 confined to the AOI and is configured to recommend corrective actions in the event of a failed defrost operation of the refrigeration units as already explained in detail with reference to FIGS. 1 to 3. The refrigeration units of different or same service providers/manufacturers at the AOI may be configured to be operatively connected to the device by configuring or programming the corresponding controllers by an expert or technician.

The device may include a set of sensors (406 of FIG. 4) to capture and monitor the parameters of the refrigeration units. Further, the device includes a communication module (408 of FIG. 4) that communicatively couples the device to the refrigeration units 108 at the AOI. Furthermore, the device is configured to transmit a set of control signals to a defrosting unit of the refrigeration units 108 to control defrosting of the corresponding refrigeration unit based on the predicted ice gradient and its priority.

While the invention has been described with reference to exemplary embodiments, it will be understood by those skilled in the art that various changes may be made, and equivalents may be substituted for elements thereof without departing from the scope of the invention as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A system to determine one or more corrective actions for one or more refrigeration units, the system comprising:

a server in communication with the one or more refrigeration units, the server comprising a processor coupled to a memory storing instructions executable by the processor and configured to:

generate a plurality of defrosting thermal models based on an analysis of a first set of data, wherein the first set of data comprises a plurality of error signatures indicative of a plurality of self-executing defrost failure instances associated with one or more refrigeration units;

determine, by the plurality of defrosting thermal models, one or more thermal features based on the first set of data;

generate one or more behavior profiles associated with the one or more refrigeration units, wherein the one or more behavior profiles corresponds to one or more causes for the plurality of self-executing defrost failure instances;

define a distinguished causal mapping between the one or more thermal features and the one or more behavior profiles; and determine one or more corrective actions for each of the plurality of self-executing defrost failure instances associated with one or more refrigeration units based on the distinguished causal mapping.

2. The system of claim 1, wherein the server is further configured to categorize the plurality of self-executing defrost failure instances into the plurality of error signatures based on an auto-detected threshold index for persistence.

3. The system of claim 2, wherein the server is further configured to identify a valid self-executing defrost failure instance whenever the auto-detected threshold index for persistence is breached.

4. The system of claim 1, wherein the server is further configured to determine one or more defrosting mechanisms applied to the one or more refrigeration units and label the determined one or more defrosting mechanisms to generate one or more defrosting labels.

5. The system of claim 4, wherein the first set of data further comprises the one or more defrosting labels.

6. The system of claim 5, wherein the server is further configured to identify a first set of thermal features from the one or more thermal features and a corresponding impact of each of the first set of thermal features on a defrost outcome for each of the one or more defrosting mechanisms.

7. The system of claim 4, wherein the first set of data further comprises operation and maintenance information associated with each of the one or more refrigeration units.

8. The system of claim 4, wherein the server is configured to determine the one or more defrosting mechanisms applied to the one or more refrigeration units based on defrost input data and defrost parameters corresponding to each of the one or more refrigeration units.

9. The system of claim 1, wherein the plurality of defrosting thermal models comprises an operation profiler, a defrost Temp by Time profiler, a defrost length profiler, a defrost set point profiler, a refrigerant Temp profiler, and supply and return Temp profiler.

10. The system of claim 1, wherein the one or more behavior profiles comprises one or more of a profile corresponding to customer operation, a profile corresponding to defrost operation, a profile corresponding to defrost performance, and a profile corresponding to one or more sensors associated with the one or more refrigeration units.

11. The system of claim 1, wherein the determined one or more corrective actions correspond to the one or more causes associated with the distinguished causal mapping between the one or more thermal features and the one or more behavior profiles.

12. The system of claim 1, wherein the server is configured to train the plurality of defrosting thermal models using one or more machine learning systems, based on the one or more thermal features corresponding to multiple behaviors of the one or more refrigeration units and corresponding maintenance information.

13. The system of claim 1, wherein the server is configured to measure an impact of the one or more recommended corrective actions, wherein the one or more recommended corrective actions are specific in nature based on multiple pattern distinctions mapped with maintenance information for each of the one or more refrigeration units.

14. A computer-implemented method for determining one or more corrective actions for one or more refrigeration units, the method comprising:

generating a plurality of defrosting thermal models based on an analysis of a first set of data to generate a plurality of defrosting thermal models, wherein the first set of data comprises a plurality of error signatures indicative of a plurality of self-executing defrost failure instances associated with one or more refrigeration units;

determining, by the plurality of defrosting thermal models, one or more thermal features based on the first set of data;

generating one or more behavior profiles associated with the one or more refrigeration units, wherein the one or more behavior profiles corresponds to one or more causes for the plurality of self-executing defrost failure instances;

defining a distinguished causal mapping between the one or more thermal features and the one or more behavior profiles; and determining one or more corrective actions for each of the plurality of self-executing defrost failure instances associated with one or more refrigeration units based on the distinguished causal mapping.

15. The method of claim 14 further comprising: categorizing the plurality of self-executing defrost failure instances into the plurality of error signatures based on an auto-detected threshold index for persistence.

16. The method of claim 15 further comprising: identifying a valid self-executing defrost failure instance whenever the auto-detected threshold index for persistence is breached.

17. The method of claim 14 further comprising: determining one or more defrosting mechanisms applied to the one or more refrigeration units and label the determined one or more defrosting mechanisms to generate one or more defrosting labels.

18. The method of claim 17 further comprising: identifying a first set of thermal features from the one or more thermal features and determining a corresponding impact of each of the first set of thermal features on a defrost outcome for each of the one or more defrosting mechanisms.

19. The method of claim 17 further comprising: determining the one or more defrosting mechanisms applied to the one or more refrigeration units based on defrost input data and defrost parameters corresponding to each of the one or more refrigeration units.

20. A device configurable with one or more refrigeration units and operable to determine one or more corrective actions for one or more refrigeration units, the device comprising:

a processing unit adapted to be operatively coupled to the one or more refrigeration units, the processing unit comprising a processor coupled to a memory storing instructions executable by the processor and configured to:

generate a plurality of defrosting thermal models based on an analysis of a first set of data to generate a plurality of defrosting thermal models, wherein the first set of data comprises a plurality of error signatures indicative of a plurality of self-executing defrost failure instances associated with one or more refrigeration units;

determine, by the plurality of defrosting thermal models, one or more thermal features based on the first set of data;

generate one or more behavior profiles associated with the one or more refrigeration units, wherein the one or more behavior profiles corresponds to one or more causes for the plurality of self-executing defrost failure instances;

define a distinguished causal mapping between the one or more thermal features and the one or more behavior profiles; and determine one or more corrective actions for each of the plurality of self-executing defrost failure instances associated with one or more refrigeration units based on the distinguished causal mapping.

* * * * *